US008248308B2

(12) United States Patent
Shimasaki

(10) Patent No.: US 8,248,308 B2
(45) Date of Patent: Aug. 21, 2012

(54) COUPLER APPARATUS

(75) Inventor: Hiroshi Shimasaki, Kunitachi (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 14 days.

(21) Appl. No.: 13/023,756

(22) Filed: Feb. 9, 2011

(65) Prior Publication Data

US 2011/0199266 A1 Aug. 18, 2011

(30) Foreign Application Priority Data

Feb. 12, 2010 (JP) ..... 2010-029219

(51) Int. Cl.
*H01Q 1/38* (2006.01)

(52) U.S. Cl. ..... 343/700 MS; 343/846; 343/848

(58) Field of Classification Search ..... 343/700 MS, 343/702, 846
See application file for complete search history.

(56) References Cited

U.S. PATENT DOCUMENTS

| | | | | |
|---|---|---|---|---|
| 6,891,510 | B2 * | 5/2005 | Le Bolzer et al. | 343/767 |
| 7,466,270 | B2 | 12/2008 | Utagawa et al. | |
| 7,518,567 | B2 | 4/2009 | Utagawa et al. | |
| 2007/0171132 | A1 | 7/2007 | Utagawa et al. | |
| 2007/0290931 | A1 | 12/2007 | Utagawa et al. | |
| 2009/0284433 | A1 | 11/2009 | Tsutsumi et al. | |

FOREIGN PATENT DOCUMENTS

| | | |
|---|---|---|
| JP | 2003-142935 | 5/2003 |
| JP | 2006-197449 | 7/2006 |
| JP | 2007-104520 | 4/2007 |
| JP | 2007-221774 | 8/2007 |
| JP | 2007-251570 | 9/2007 |
| JP | 2007-336296 | 12/2007 |
| JP | 2009-278535 | 11/2009 |

OTHER PUBLICATIONS

Notice of Reasons for Rejection mailed by the Japan Patent Office on May 31, 2011 in the corresponding Japanese patent app. No. 2010-029219 in 6 pages.

Notice of Reasons for Rejection mailed by the Japan Patent Office on Aug. 9, 2011 in the corresponding Japanese patent app. No. 2010-029219 in 5 pages.

* cited by examiner

*Primary Examiner* — Hoang V Nguyen

(74) *Attorney, Agent, or Firm* — Knobbe, Martens, Olson & Bear LLP

(57) ABSTRACT

According to one embodiment, a coupler apparatus includes a coupling element, a ground plane, a first short element, and a second short element which short-circuits the second end of the coupling element and the ground plane. The coupling element includes a first conductive portion having first and second ends, and a second conductive portion which extends from a position between the first end and the second end and has an open end. The ground plane faces the coupling element and formed of a conductive material. The first short element short-circuits the first end of the coupling element and the ground plane The second short element short-circuits the second end of the coupling element and the ground plane.

10 Claims, 11 Drawing Sheets

COUPLER APPARATUS

CROSS-REFERENCE TO RELATED APPLICATIONS

This application is based upon and claims the benefit of priority from Japanese Patent Application No. 2010-029219, filed Feb. 12, 2010; the entire contents of which are incorporated herein by reference.

FIELD

Embodiments described herein relate generally to a coupler apparatus.

BACKGROUND

Development of Transfer jet has advanced as a proximity wireless communication system between two communication devices which are in proximity to each other to form a gap of approximately several cm therebetween.

To perform communication by utilizing this type of proximity wireless communication system, coupler apparatuses having two communication devices mounted thereon, respectively, are proximally positioned to face each other. Each coupler apparatus includes a coupling element and utilizes electromagnetic coupling between the coupling elements to transmit or receive electromagnetic waves.

A coupler apparatus is generally constituted by arranging a coupling element and a ground plane, each of which is obtained by forming a conductive material into a tabular shape, to face each other. Further, in the coupler apparatus on a transmission side, an electromagnetic field is generated around the coupler apparatus by feeding a signal to a portion between the coupling element and the ground plane to generate an electric current in the coupling element, thereby producing electromagnetic coupling between this coupler apparatus and a coupler apparatus on a reception side. In the coupler apparatus on the reception side, the above-described signal can be fetched in accordance with a potential difference between the coupling element and the ground plane when the electric current is generated in the coupling element based on the produced electromagnetic coupling.

In this type of coupler apparatus, electromagnetic coupling concerning a necessary frequency band is generated by an electric current produced between a feeding point and an open end.

On the other hand, a short element may be arranged between the coupling element and the ground plane to short-circuit the coupling element and the ground plane. In this case, the short element is provided at one position avoiding a current path between the feeding point and the open end.

Meanwhile, in the coupler apparatus having the short element provided therein, an electric current flowing on the coupling element between the feeding point and the short element is also generated. Further, this current becomes larger than the current between the feeding point and the open end, and it is generated while being biased toward one direction from the feeding point, whereby a current distribution of the entire coupler apparatus is biased. Furthermore, such bias of the current distribution may possibly lead to a reduction in a degree of coupling with another coupler apparatus.

It is to be noted that JP-A 2006-197449 (KOKAI) discloses an antenna apparatus having two short-circuit pins provided between a top plate conductor and a ground plane conductor.

However, in the antenna apparatus disclosed in the above-described document, the short-short pins are arranged in the middle of a path for a current flowing through the top plate conductor. That is because the antenna apparatus disclosed in the above-described document is configured to be omnidirectional on a plane where the top plate conductor is present and to have characteristics of avoiding emission of an electric wave in a direction orthogonal to the top plate conductor and this apparatus utilizes an electromagnetic function absolutely different from the coupler apparatus that produces electromagnetic coupling in a direction orthogonal to the coupling element.

Under such circumstances, the coupler apparatus has been demanded to enable suppressing a change in transmission coefficient involved by rotation around central axis even in a state that it faces another coupler apparatus with their central axes deviating from each other.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Various embodiments will be described hereinafter with reference to the accompanying drawings.

In general according to one embodiment, a coupler apparatus includes a coupling element, a ground plane, a first short element, and a second short element which short-circuits the second end of the coupling element and the ground plane. The coupling element includes a first conductive portion having first and second ends; and a second conductive portion which extends from a position between the first end and the second end and has an open end. The ground plane faces the coupling element and formed of a conductive material. The first short element short-circuits the first end of the coupling element and the ground plane The second short element short-circuits the second end of the coupling element and the ground plane.

First Embodiment

Figure 1:
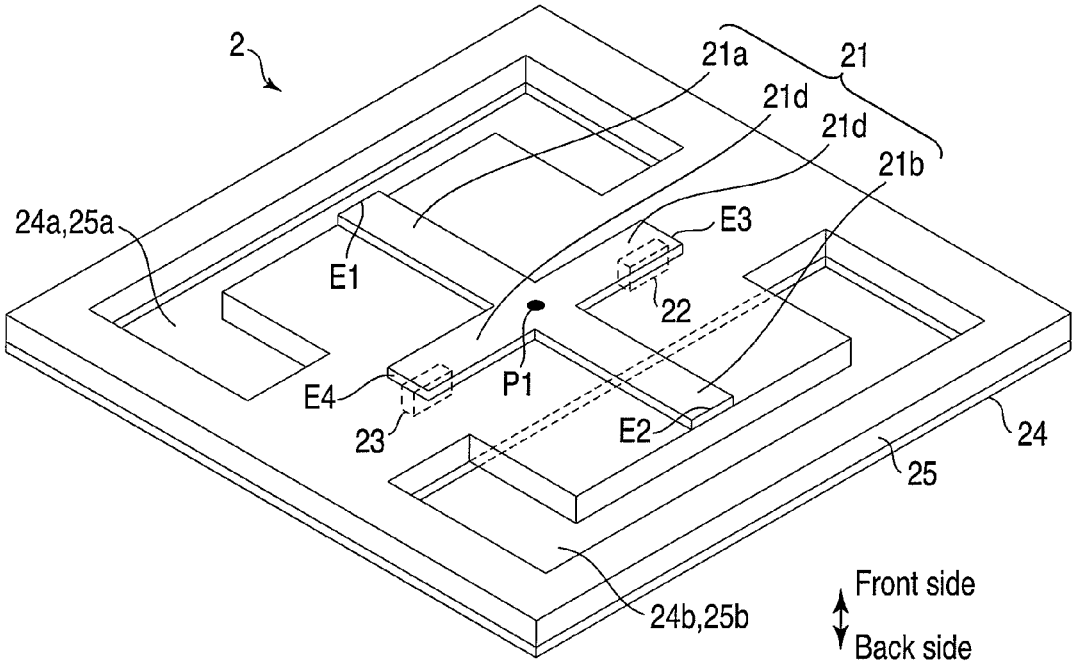
FIG. 1 is a perspective view of a coupler apparatus according to a first embodiment.
Figure 2:
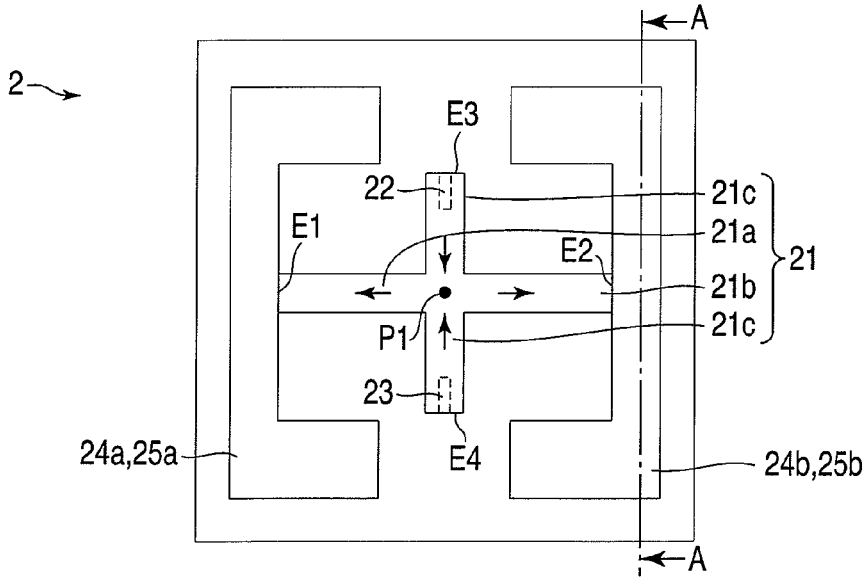
FIG. 2 is a plan view of the coupler apparatus depicted in FIG. 1.
Figure 3:
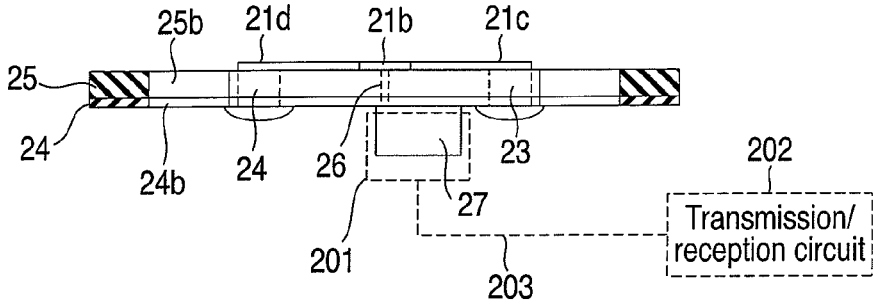
FIG. 3 is a cross-sectional view taken through A-A as indicated by arrowheads in FIG. 2.
Figure 4:
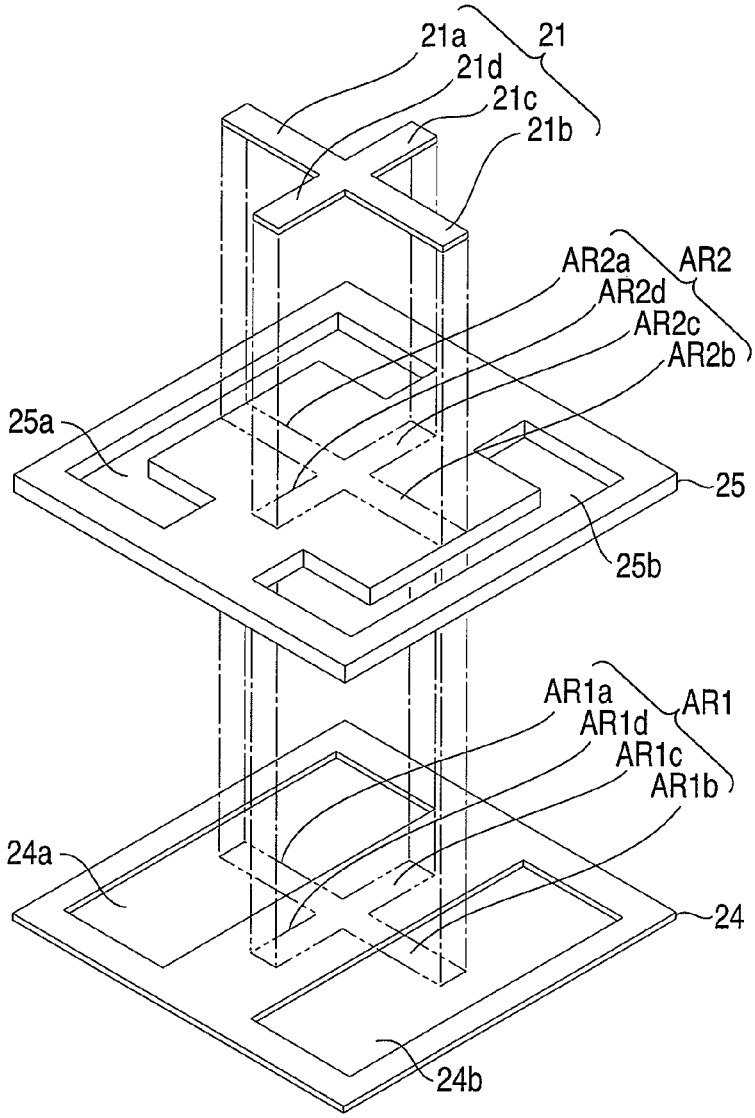
FIG. 4 is an exploded perspective view of the coupler apparatus depicted in FIG. 1.

FIG. 1 is a perspective view of a coupler apparatus 2 according to a first embodiment. FIG. 2 is a plan view of the coupler apparatus 2. FIG. 3 is a cross-sectional view taken through A-A as indicated by arrowheads in FIG. 2. FIG. 4 is an exploded perspective view of a coupler apparatus 2.

As shown in FIG. 1 to FIG. 4, the coupler apparatus 2 includes a coupling element 21, short elements 22 and 23, a ground plane 24, and a dielectric 25. Further, as shown in FIG. 3, the coupler apparatus 2 also includes a feeder cable 26 and a connector 27.

Each of the coupling element 21, the ground plane 24, and the dielectric 25 has a tabular shape, and the coupling element 21, the dielectric 25, and the ground plane 24 are aligned in their thickness directions in the mentioned order with these thickness directions being substantially uniformed. It is to be noted that an alignment direction (a thickness direction/a height direction) of the coupling element 21, the dielectric 25, and the ground plane 24 is determined as a front-and-back direction of the coupler apparatus 2, and the coupling element 21 side is determined as a front side. That is, the coupling element 21 is placed on the front side of the dielectric 25, and the ground plane 24 is placed on the back side of the dielectric 25.

The coupling element 21 is obtained by forming a conductive material into such a shape as depicted in FIG. 1 to FIG. 4. The coupling element 21 has a cross shape on a plane orthogonal to its thickness direction. That is, in the coupling element 21, four rectangular portions 21*a*, 21*b*, 21*c*, and 21*d* extending from the center in four different directions, respectively, are present. It is desirable for the rectangular portion 21*a* and the rectangular portion 21*b* to have the same length, but it is not an indispensable requisite. Further, it is desirable for the rectangular portion 21*c* and the rectangular portion 21*d* to have the same length, but it is not an indispensable requisite. It is determined that each of the rectangular portions 21*a* and 21*b* has a width that allows a high-frequency signal that is transmitted or received with respect to another coupling apparatus to be supplied in a substantially entire region.

Thus, the rectangular portions 21*c* and 21*d* form a first conductive portion having two ends E3 and E4. Furthermore, the rectangular portions 21*a* and 21*b* form second and third conductive portions having open ends E1 and E2. Moreover, the open ends E1 and E2 are provided at positions symmetrical with respect to the center of the end E3 and the end E4.

Each of the short elements 22 and 23 is obtained by forming a conductive material into a rectangular tabular shape, and its thickness direction is orthogonal to a thickness direction of the coupling element 21. The short elements 22 and 23 are joined and connected to the coupling element 11 at ends of the rectangular portions 21*c* and 21*d*, respectively. The short elements 22 and 23 may be integrated with or separated from the coupling element 21. The short elements 22 and 23 are arranged to penetrate through the dielectric 25 and electrically connected with the ground plane 24.

The ground plane 24 is obtained by forming a thin layer made of a conducive material on a substantially entire surface of the dielectric 25 and functions as a ground electrode. This ground plane 24 may be or may not be electrically connected with a metal housing of a communication device in which the coupler apparatus 2 is mounted. The ground plane 24 is apart from the coupling element 21 in such a manner that direct conduction without interposing the short elements 22 and 23 between the ground plane 24 and the coupling element 21 cannot be produced. Rectangular notches 24*a* and 24*b* are formed in the ground plane 24 to penetrate through the ground plane 24 in the front-and-back direction. Each of the notches 24*a* and 24*b* is provided near a region in the ground plane 24 facing at least a part of the coupling element 21.

A projection region when the coupling element 21 is projected onto the front-side surface of the ground plane 24 in the front-and-back direction (a region facing the coupling element 21) is a region AR1 indicated by an alternate long and two short dashes line in FIG. 4. It can be understood from this FIG. 4 that, since regions AR1*a* and AR1*b* in the region AR1 associated with the rectangular portions 21*a* and 21*b* partially overlap the notches 24*a* and 24*b*, the notches 24*a* and 24*b* are provided to face parts of the rectangular portions 21*a* and 21*b*, i.e., the notches 24*a* and 24*b* are provided near the regions AR1*a* and AR1*b* (adjoining regions). Further, it can be also understood that, since a portion near an intersecting portion in the region AR1 does not overlap both the notches 24*a* and 24*b*, the notches 24*a* and 24*b* do not face a feeding point P1. Furthermore, it can be also understood that, since regions AR1*c* and AR1*d* in the region AR1 associated with the rectangular portions 21*c* and 21*d* do not overlap both the notches 24*a* and 24*b*, the short elements 22 and 23 can come into contact with the ground plane 24.

The dielectric 25 is obtained by forming a dielectric material into a plate-like shape. The dielectric 25 is arranged in a gap between the coupling element 21 and the ground plane 24. In the first embodiment, the dielectric 25 has a thickness substantially equal to the gap between the coupling element 21 and the ground plane 24 to fill the gap between the coupling element 21 and the ground plane 24. Therefore, a greater part of each of the short elements 22 and 23 is placed in the dielectric 25. However, the thickness of the dielectric 25 may be smaller than the gap between the coupling element 21 and the ground plane 24. When the thickness of the dielectric 25 is smaller than the gap between the coupling element 21 and the ground plane 24, the dielectric 25 is typically arranged to be in contact with the ground plane 24 and to be apart from the coupling element 21. However, the dielectric 25 may be arranged to be in contact with the coupling element 21 and to be apart from the ground plane 24. Alternatively, the dielectric 25 may be arranged to be apart from both the coupling element 21 and the ground plane 24. Moreover, a first dielectric that is in contact with the coupling element 21 and a second dielectric that is in contact with the ground plane 24 may be individually provided, and these first and second dielectric bodies may be arranged to be apart from each other. U-shaped notches 25*a* and 25*b* are formed in the dielectric 25 to penetrate through the dielectric 25 in the front-and-back direction. The notches 25*a* and 25*b* are provided near regions in the dielectric 25 facing at least a part of the coupling element 21.

It is to be noted that each of the notches 25*a* and 25*b* has a U-like shape in this embodiment, it may have any other shape. A shape of each of the notches 24*a* and 24*b* provided in the ground plane 24 may be arbitrary.

A projection region when the coupling element 21 is projected onto the front surface side of the dielectric 25 (a region facing the coupling element 21) is a region AR2 indicated by an alternate long and two short dashes line in FIG. 4. It can be understood from FIG. 4 that, since regions AR2*a*, AR2*b*, AR2*c*, and AR2*d* in the region AR2 associated with the rectangular portions 21*a*, 21*b*, 21*c*, and 21*d* do not overlap the notches 25*a* and 25*b*, the notches 25*a* and 25*b* are provided in such a manner that they do not face all of the coupling element 21.

The feeder cable 26 is arranged to run through the ground plane 24 and the dielectric 25. One end of the feeder cable 26 is connected to the feeding point P1 at a central part of the coupling element 21, and the other end of the same is connected to the connector 27. The feeder cable 26 is insulated from the ground plane 24.

The connector 27 is fixed to the ground plane 24 through, e.g., soldering. In a state that the coupler apparatus 2 is mounted on a communication device, a connector 201 is coupled with this connector 27. The connector 201 is connected with a transmission/reception circuit 202 mounted on the communication device through a cable 203. Further, in a state that the connectors 27 and 201 are coupled with each other, the feeder cable 26 is electrically connected with a feeder wire of the cable 203, and a ground wire of the cable 203 is electrically connected with the ground plane 24.

It is to be noted that the coupler apparatus 2 feeds electric power to the feeding point P1 through the connector 27 provided on the ground plane 24 side in the example depicted in FIG. 1 to FIG. 4, but the feeding method and the mounting method are not restricted thereto. For example, the coupler apparatus 2 may be mounted as a substrate that is integrated with the transmission/reception circuit 202, and in may be mounted in such a manner that electric power is fed to the feeding point P1 on the coupling element 21 side as a pattern of this substrate. Moreover, the feeder wire of the cable 203 may be directly connected to the feeding point P1 and the ground plane 24 without using connectors.

Figure 5:
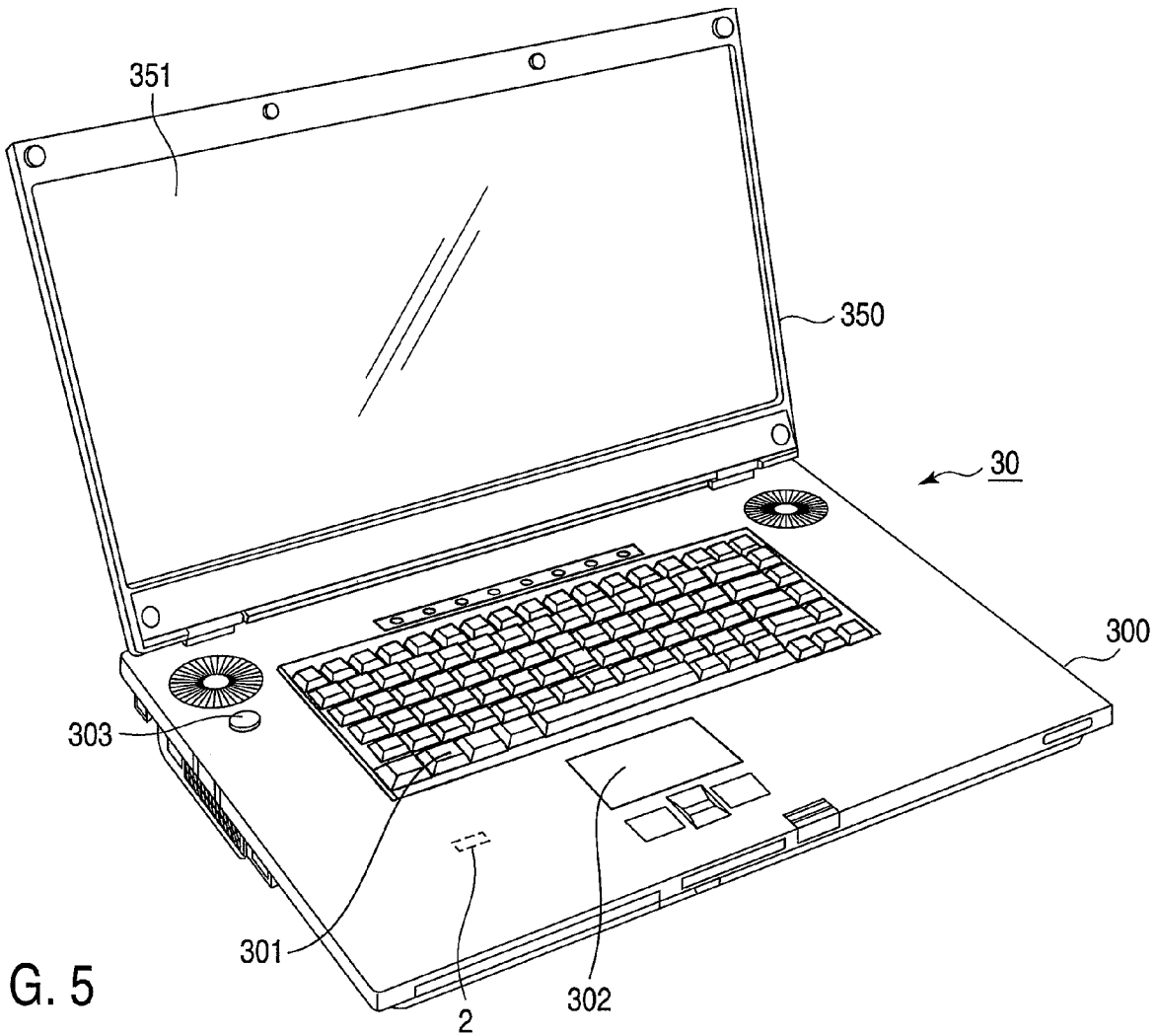
FIG. 5 is a perspective view showing an appearance of an information processing apparatus as an example of a device in which the coupler apparatus depicted in FIG. 1 to FIG. 3 is mounted.

FIG. 5 is a perspective view showing an appearance of an information processing apparatus 30 as an example of a device on which the coupler apparatus 2 is mounted. This information processing apparatus 30 is realized as, e.g., a notebook type portable personal computer that can be driven by a battery.

The information processing apparatus 30 includes a main body 300 and a display unit 350. The display unit 350 is supported by the main body 300 to allow its swiveling motion. The display unit 350 can form an opened state where an upper surface of the main body 300 is exposed and a closed state where the upper surface of the main body 300 is covered. In the display unit 350, a liquid crystal display (LCD) 351 is provided.

The main body 300 has a thin box-like housing. In the main body 300, a keyboard 301, a touch pad 302, a power switch 303, and others are arranged in a state where these members are exposed to the outside of the housing from an upper surface of the housing. Furthermore, in the main body 300, the coupler apparatus 2 is provided in the housing. A direction of the coupler apparatus 2 in the main body 300 may be arbitrary. However, the Z direction in FIG. 1 is typically set to coincide with a direction orthogonal to the upper surface of the housing of the main body 300. Moreover, the coupling element 21 rather than the ground plane 24 is typically placed near the upper surface of the housing of the main body 300.

The coupler apparatus 2 is utilized to perform proximity wireless communication between the information processing apparatus 30 and the other non-illustrated apparatus. The proximity wireless communication is executed in a peer-to-peer system. A communication enabled range is, e.g., approximately 3 cm. Wireless connection between communication terminals is achieved only when a distance between the coupler apparatuses 1 mounted in the respective communication terminals becomes equal to or below the communication enabled range. Further, when the distance between the two coupler apparatuses 1 becomes equal to or below the communication enabled range, the wireless communication between the two communication terminals is achieved. Furthermore, data such as a data file specified by a user or a predetermined synchronization target data file is transmitted or received between the two communication terminals.

In the example depicted in FIG. 5, the coupler apparatus 2 is arranged below a region that functions as a palm rest (which will be referred to as a palm rest region hereinafter) on the upper surface of the main body 300. Therefore, a part of the palm rest region functions as a communication surface. That is, when the other communication terminal that is to perform the proximity wireless communication with the information processing apparatus 30 is moved closer to the palm rest region, the wireless connection between this communication terminal and the information processing apparatus 30 can be achieved.

Figure 6:
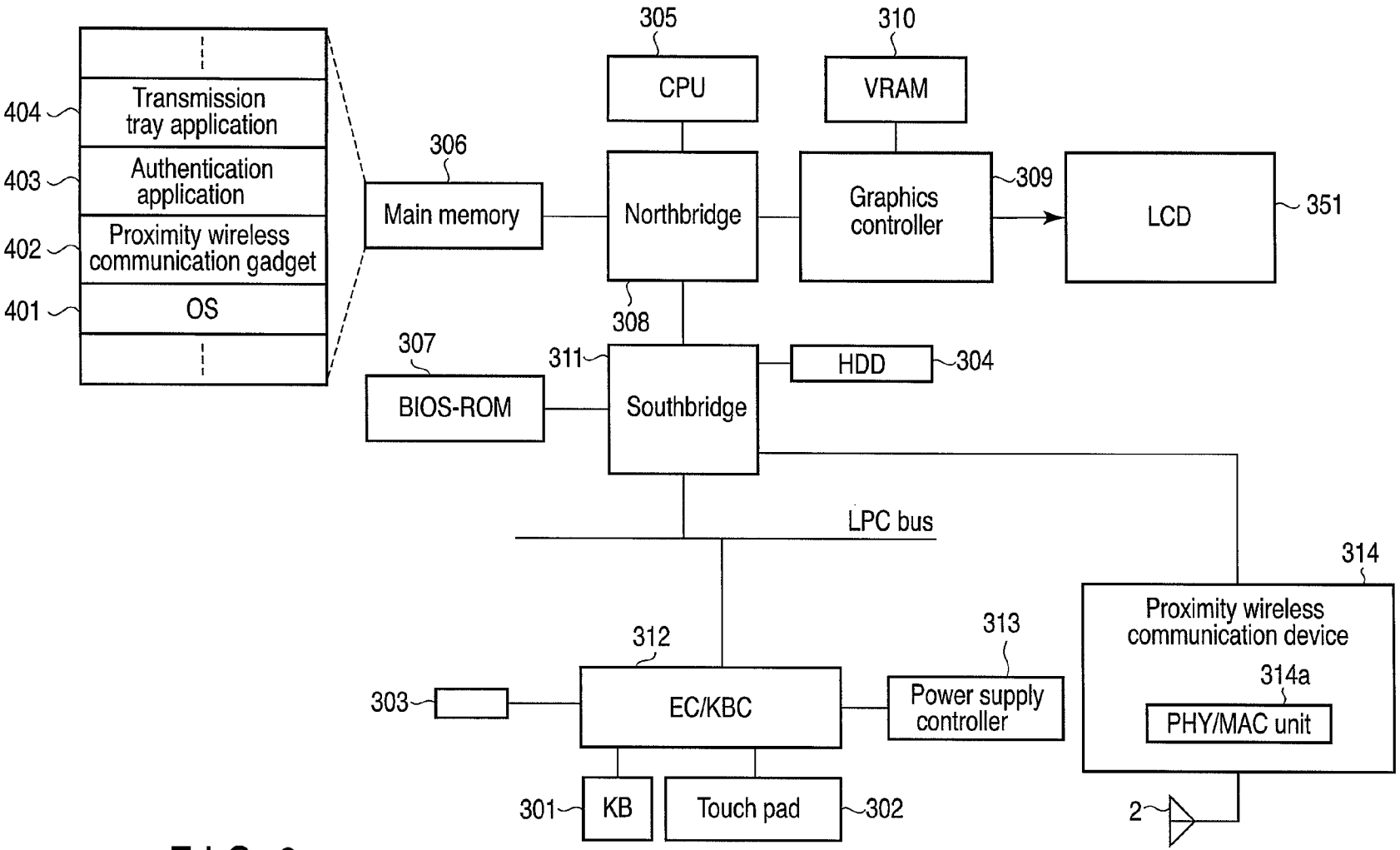
FIG. 6 is a block diagram of an information processing apparatus depicted in FIG. 5.

FIG. 6 is a block diagram of the information processing apparatus 30. It is to be noted that like reference numerals denote parts equal to those in FIG. 5.

The information processing apparatus 30 includes the coupler apparatus 2, the keyboard 301, the touch pad 302, the power switch 303, and the LCD 351, and this apparatus also includes a hard disk drive (HDD) 304, a CPU 305, a main memory 306, a basic input/output system-ROM (BIOS-ROM) 307, a northbridge 308, a graphics controller 309, a video memory (VRAM) 310, a southbridge 311, an embedded controller/keyboard controller IC (EC/KBC) 312, a power supply controller 313, and a proximity wireless communication device 314.

The hard disk drive 304 stores codes required to execute an operating system (OS) or various kinds of programs such as an BIOS update program.

The CPU 305 executes various kinds of programs loaded to the main memory 306 from the hard disk drive 304 in order to control operations of the information processing apparatus 30. Programs executed by the CPU 305 include an operating system 401, a proximity wireless communication gadget application program 402, an authentication application program 403, or a transmission tray application program 404.

Additionally, the CPU 305 executes a BIOS program stored in the BIOS-ROM 307 to control hardware.

The northbridge 308 connects a local bus of the CPU 305 and the southbridge 311. The northbridge 308 has a built-in memory controller that controls access of the main memory 306. Further, the northbridge 308 has a function of executing communication with the graphics controller 309 via an AGP bus and the like.

The graphics controller 309 controls the LCD 351. The graphics controller 309 generates a video signal representing a display image that is displayed in the LCD 351 from display data stored in the video memory 310. It is to be noted that the display data is written into the video memory 310 under control of the CPU 305.

The southbridge 311 controls devices on an LPC bus. The southbridge 311 has a built-in ATA controller configured to control the hard disk drive 304. Furthermore, the southbridge 311 has a function of controlling access of the BIOS-ROM 307.

The embedded controller/keyboard controller IC (EC/KBC) 312 is a one-chip microcomputer in which an embedded controller and a keyboard controller are integrated. The embedded controller controls a power supply controller to turn on/off the information processing apparatus 30 in accordance with operations of the power switch 303 by a user. The keyboard controller controls the keyboard 301 and the touch pad 302.

The power supply controller 313 controls operations of a non-illustrated power supply apparatus. It is to be noted that the power supply apparatus generates operation power for each unit in the information processing apparatus 30.

The proximity wireless communication device 314 includes a PHY/MAC unit 314*a*. The PHY/MAC unit 314*a* operates under control of the CPU 305. The PHY/MAC unit 314*a* communicates with the other communication terminal through the coupler apparatus 2. This proximity wireless communication device 314 corresponds to the transmission/reception circuit 202 in FIG. 3. The proximity wireless communication device 314 is accommodated in a case of the main body 300.

It is to be noted that a peripheral component interconnect (PCI) bus is utilized for data transfer between the proximity wireless communication device 314 and the southbridge 311. It is to be noted that a PCI Express may be used in place of the PCI.

An operation of the thus configured coupler apparatus 2 will now be described.

When a high-frequency signal is transmitted from the transmission/reception circuit 202, this high-frequency signal is supplied to the feeding point P1 of the coupling element 21 through the cable 203, the connector 201, the connector 27, and the feeder cable 26. At this moment, the ends E1 and E2 of the rectangular portions 21*a* and 21*b* function as open ends, whereby two current paths leading to the ends E1 and E2 from the feeding point P1, respectively, are generated. It is to be noted that a current is produced in a substantially entire region of each of the rectangular portions 21*a* and 21*b*. Therefore, it can be considered that the current paths in the rectangular portions 21*a* and 21*b* run through central parts of the rectangular portions 21*a* and 21*b*.

Further, the currents generated in the rectangular portions 21*a* and 21*b* of the coupler apparatus 2 on the transmission side serve as coupling currents, thereby producing an electromagnetic wave around the coupler apparatus 2 on the transmission side. Furthermore, this electromagnetic wave induces a current in the coupling element 21 of the coupler apparatus 2 on the reception side. In this manner, the high-frequency signal is transmitted/received between the two coupler apparatuses 2. Here, a size of the coupling element 21 is determined in such a manner that a length of each of the two current paths substantially corresponds to n/4 (n is an arbitrary integer) of a wavelength λ of a necessary frequency. As a result, the high-frequency signal in a frequency band having the necessary frequency as a central frequency can be efficiently transmitted/received.

Meanwhile, since the rectangular portions 21*c* and 21*d* are grounded to the ground plane 24 by the short elements 22 and 23, the ends E3 and E4 of the rectangular portions 21*c* and 21*d* serve as ground ends. Moreover, two current paths leading to the ends E3 and E4 from the feeding point P1 are generated, and ground currents flow through the rectangular portions 21*c* and 21*d*. However, since these two ground currents have different directions, bias of a current distribution in the entire coupler apparatus 2 is smaller than that in an example where the single ground end is provided.

In this embodiment in particular, since the rectangular portions 21*c* and 21*d* have a point-symmetric shape with the feeding point P1 at the center, these two ground currents are also symmetrical, and the current distribution in the entire coupler apparatus 2 is rarely biased by these ground currents.

However, even if the rectangular portions 21*c* and 21*d* are not linearly aligned or the rectangular portions 21*c* and 21*d* have different lengths, the bias of the current distribution can be adjusted to be smaller than that of the conventional coupler apparatus 1 as long as the rectangular portions 21*c* and 21*d* are placed on side facing each other to sandwich a plane that includes the feeding point P1 and is parallel to the front-and-back direction. Therefore, the shape that the rectangular portions 21*c* and 21*d* are point-symmetric with the feeding point P1 at the center is not an essential requisite.

It is to be noted that a Q value increases as the rectangular portions 21*c* and 21*d* are shortened. That is, a band of electromagnetic coupling is narrowed and a degree of coupling increases as the rectangular portions 21*c* and 21*d* become shorter. Therefore, it is desired for lengths of the rectangular portions 21*c* and 21*d* to be appropriately determined while considering a band and a degree of coupling to be demanded.

Meanwhile, in the above-described use state, since the ground plane 24 is grounded and the coupling element 21 and the ground plane 24 are close to each other, energy of the current produced in the coupling element 21 partially directly leaks to the ground plane 24. However, in the coupler apparatus 2, since the notches 24*a* and 24*b* are formed, the ground plane 24 does not face a part of each of the notches 21*a* and 21*b*. Therefore, as compared with an example where the notches 24*a* and 24*b* are not formed, an amount of the energy that directly leaks to the ground plane 24 from the coupling element 21 is reduced. Additionally, since the notches 25*a* and 25*b* are formed, concentration of an electric field between the ground plane 24 and the coupling element 21 can be reduced to be smaller than that in an example where the notches 25*a* and 25*b* are not formed. Further, as a result, an amount of energy utilized for electromagnetic coupling with the coupler apparatus as an intended party for communication increases, thereby improving a degree of coupling (S21).

Figure 7:
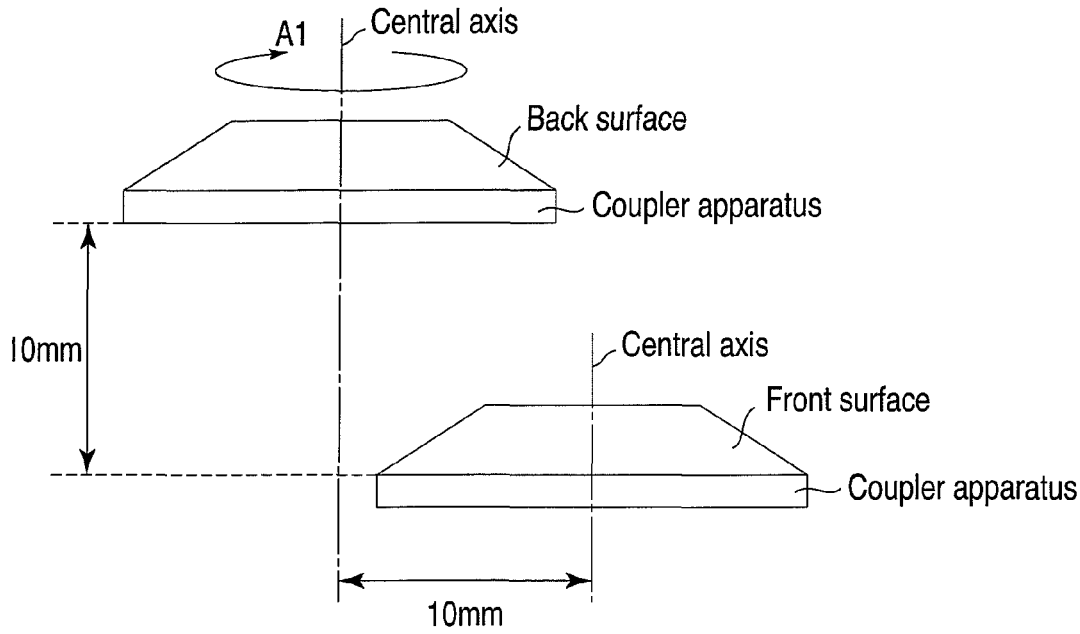
FIG. 7 is a view showing conditions for obtaining frequency characteristics of a transmission coefficient (S21) of two coupler apparatuses.
Figure 8:
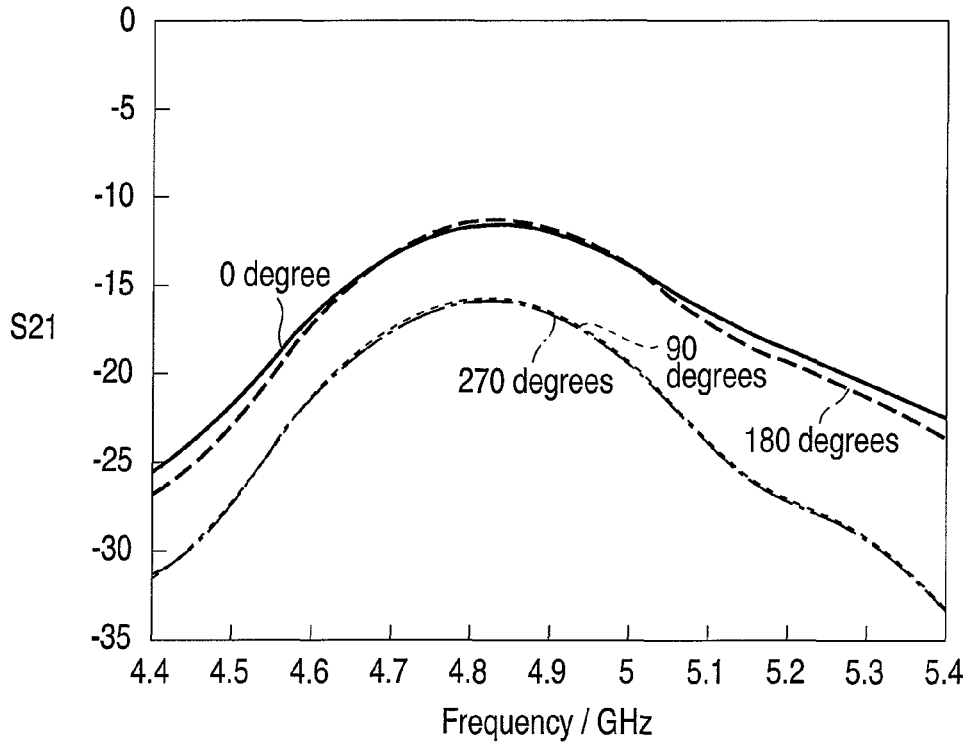
FIG. 8 is a view showing simulation data concerning frequency characteristic of a transmission coefficient (S21) of the coupler apparatuses depicted in FIG. 1 to FIG. 3.

For example, FIG. 8 shows simulation data concerning frequency characteristics of a transmission coefficient (S21) in an example where the two coupler apparatuses 2 face each other in such a positional relationship as depicted in FIG. 7. It is to be noted that the positional relationship depicted in FIG. 7 is based on the following conditions.

- Respective front surfaces of the two coupler apparatuses face each other.
- Respective central axes of the two coupler apparatuses are parallel to each other.
- A gap between front surfaces of the two coupler apparatuses in a direction parallel to the central axes is 10 mm.
- A gap between the central axes in a direction orthogonal to the central axes is 10 mm.
- A state that the same ground end faces the same direction is determined as 0 degree, and states that the coupler apparatus 1 placed on the upper side in FIG. 7 is rotated in a direction of an arrow A1 around its central axis every 90 degrees from the state of 0 degree are determined as 90 degrees, 180 degrees, and 270 degrees, respectively.

Second Embodiment

Figure 9:
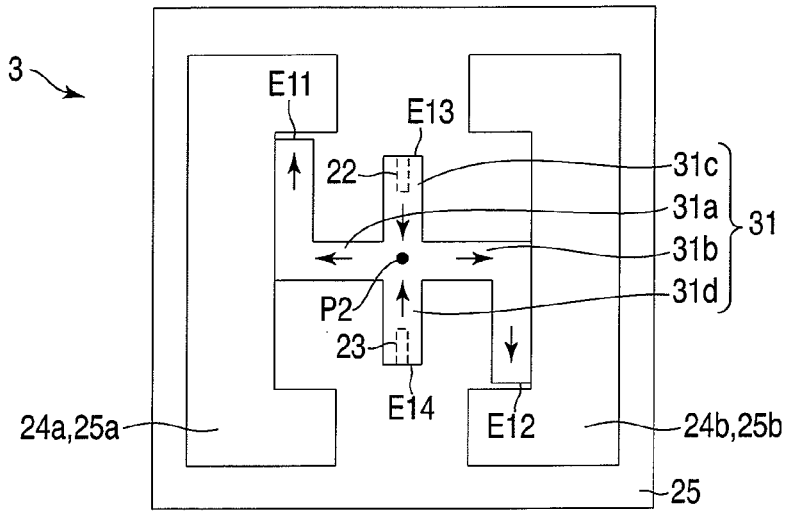
FIG. 9 is a plan view of a coupler apparatus according to a second embodiment.

FIG. 9 is a plan view of a coupler apparatus 3 according to a second embodiment. It is to be noted that like reference numerals denote parts equal to those in FIG. 1 to FIG. 3 to omit a detailed description thereof.

As shown in FIG. 9, the coupler apparatus 3 includes short elements 22 and 23, a ground plane 24, a dielectric 25, and a coupler element 31. Furthermore, the coupler apparatus 3 also includes such a feeder cable 26 and a connector 27 as depicted in FIG. 3, but the feeder cable 26 and the connector 27 are omitted in FIG. 9.

That is, the coupler apparatus 3 includes the coupling element 31 in place of the coupling element 21 in the coupler apparatus 2. Moreover, the coupling element 31 and the coupling element 21 have different shapes on a plane orthogonal to each of their thickness directions.

In the coupling element 31, L-shaped portions 31*a* and 31*b* and the rectangular portions 31*c* and 31*d* are present. The L-shaped portions 31*a* and 31*b* have an L-like shape whose bending angle is 90 degrees, and they are point-symmetric with a feeding point P2 at the center. Additionally, the rectangular portions 31*c* and 31*d* are orthogonal to the L-shaped portions 31*a* and 31*b* at the feeding point P2. It is to be noted that each of the L-shaped portions 31*a* and 31*b* has a width that allows a high-frequency signal transmitted/received with respect to another coupler apparatus to be supplied in a substantially entire region.

Thus, the rectangular portions 31*c* and 31*d* form a first conductive portion having two ends E13 and E14. Further, the rectangular portions 31*a* and 31*b* form second and third conductive portions having ends E11 and E12, respectively. Further, the ends E11 and E12 are provided at position symmetrical about the center of the end E13 and the end E14.

The short elements 22 and 23 are joined and connected with the coupling element 31 at ends of the rectangular portions 31*c* and 31*d*.

In this coupling element 31, the ends E11 and E12 of the L-shaped portions 31*a* and 31*b* serve as open ends, and the ends E13 and E14 of the rectangular portions 31*c* and 31*d* function as ground ends, respectively. Therefore, in the coupling element 31, a current path leading to the end E11 from the feeding point P2 through the L-shaped portion 31*a* and a current path leading to the end E12 from the feeding point P2 through the L-shaped portion 31*b* are generated. A size of the coupling element 31 is determined in such a manner that a length of each of these two current paths corresponds to n/4 (n is an arbitrary integer) of a wavelength λ of a necessary frequency.

Thus, in the coupling element 31, since ground currents flowing through the rectangular portions 31*c* and 31*d* have different directions, bias of a current distribution in the entire coupler apparatus 3 is smaller than that in an example where the single ground end is provided.

In this embodiment in particular, since the rectangular portions 31*c* and 31*d* have a point-symmetric shape with the feeding point P2 at the center, the two ground currents are also symmetrical, and the current distribution in the entire coupler apparatus 3 is hardly biased by these currents.

Meanwhile, although electromagnetic coupling of the two coupler apparatuses 3 is realized by currents generated in the L-shaped portions 31*a* and 31*b*, the coupling currents generated in the L-shaped portions 31*a* and 31*b* include current components in four directions which differ every 90 degrees as indicated by arrows in FIG. 9. Therefore, when the two coupler apparatuses 2 face each other in a positional relationship depicted in FIG. 7, both the coupler apparatuses 2 includes current components in opposed directions in all of the states of 0 degree, 90 degrees, 180 degrees, and 270 degrees, thus reducing a change in degree of coupling in each state.

Figure 10:
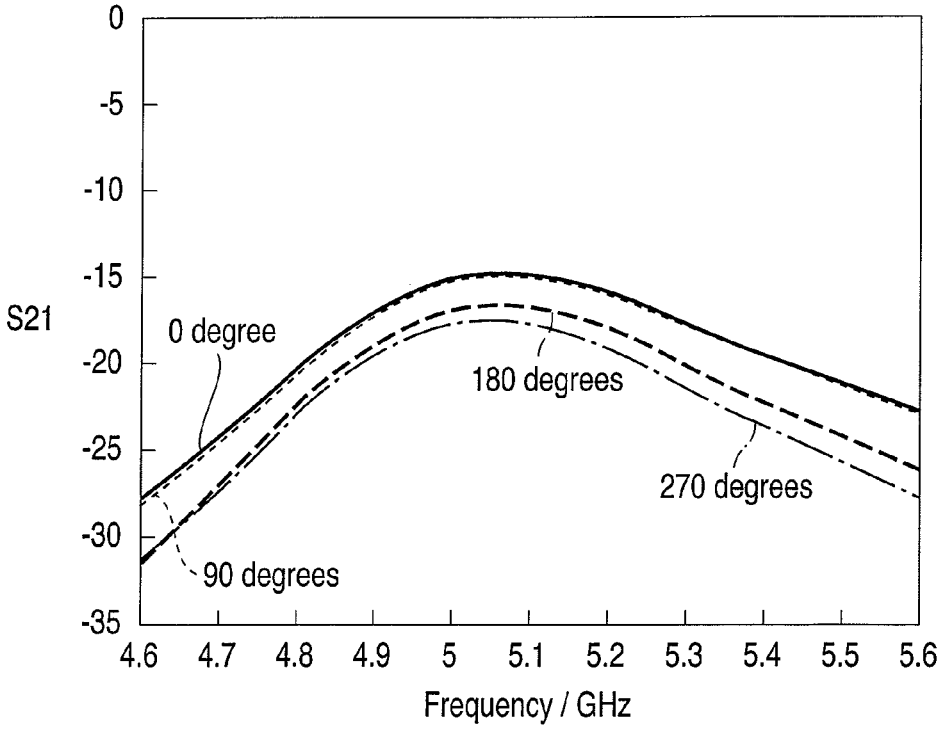
FIG. 10 is a view showing simulation data concerning frequency characteristics of a transmission coefficient (S21) of the coupler apparatuses depicted in FIG. 9.

FIG. 10 is a view showing simulation data concerning frequency characteristics of a transmission coefficient (S21) in the two coupler apparatuses 3. In regard to the characteristics depicted in this FIG. 9, the transmission coefficient (S21) when the two coupler apparatuses 3 face each other in the positional relationship depicted in FIG. 7 is obtained by computer simulation.

However, the current distribution in the entire apparatus 3 is biased due to the currents on the end sides of the L-shaped portion 31*a* and 31*b* as compared with the coupler apparatus 2. However, the coupling currents in the L-shaped portions 31*a* and 31*b* are smaller than the ground currents in the rectangular portions 31*c* and 31*d*, and the coupling currents are reduced as getting closer to the ends E11 and E12. Therefore, an influence of the currents on the end side of the L-shaped portions 31*a* and 31*b* with respect to the current distribution is small.

It is to be noted that a bending angle of each of the L-shaped portions 31*a* and 31*b* may be other than 90 degrees, and the L-shaped portions 31*a* and 31*b* may have different bending angles. The L-shaped portions 31*a* and 31*b* may have shapes different from each other. An angle formed by the L-shaped portions 31*a* and 31*b* at the feeding point P2 may be other than 180 degrees. However, the L-shaped portions 31*a* and 31*b* are placed on sides facing each other to sandwich a plane that includes the feeding point P2 and is parallel to the front-and-back direction.

On the other hand, the rectangular portions 31*c* and 31*d* may have shapes different from each other. An angle formed by the rectangular portions 31*c* and 31*d* at the feeding point P2 may be other than 180 degrees. However, the L-shaped portions 31*a* and 31*b* are placed on sides facing each other to sandwich a plane that includes the feeding point P2 and is parallel to the front-and-back direction.

Third Embodiment

Figure 11:
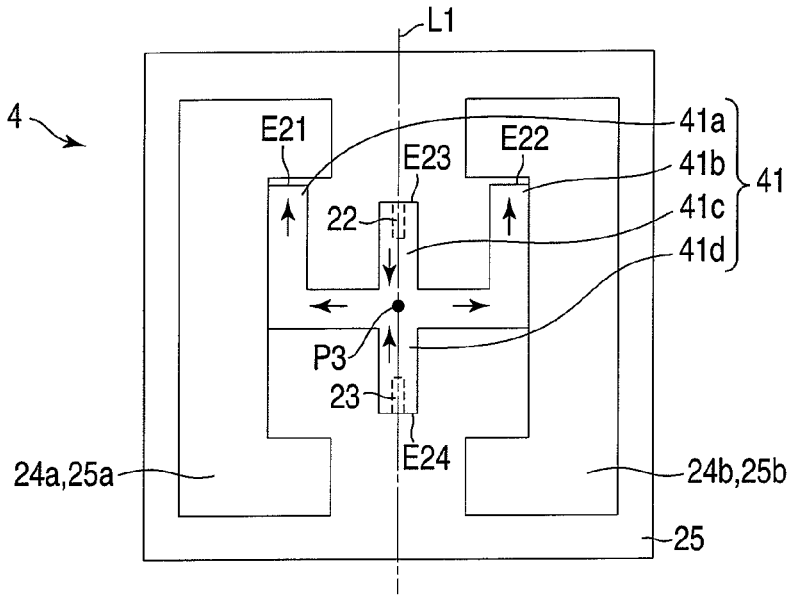
FIG. 11 is a plan view of a coupler apparatus according to a third embodiment.

FIG. 11 is a plan view of a coupler apparatus 4 according to a third embodiment. It is to be noted that like reference numerals denote parts equal to those in FIG. 1 to FIG. 3 to omit a detailed description thereof.

As shown in FIG. 11, the coupler apparatus 4 includes short elements 22 and 23, a ground plane 24, a dielectric 25, and a coupling element 41. Additionally, the coupler apparatus 4 also includes such a feeder cable 26 and a connector 27 as depicted in FIG. 3, but the feeder cable 26 and the connector 27 are omitted in FIG. 11.

That is, the coupler apparatus 4 includes the coupling element 41 in place of the coupling element 21 in the coupler apparatus 2. Furthermore, the coupling element 41 and the coupling element 21 have different shapes on a plane orthogonal to each of their thickness directions.

In the coupling element 41, L-shaped portions 41*a* and 41*b* and rectangular portions 41*c* and 41*d* are present. The L-shaped portions 41*a* and 41*b* have an L-like shape whose bending angle is 90 degrees and are line-symmetric with respect to a straight line L1 running through a feeding point P3 on the plane. The rectangular portions 41*c* and 41*d* have a rectangular shape and are point-symmetric with the feeding point P3 at the center. Further, the rectangular portions 41*c* and 41*d* are aligned on the straight line L1 along the straight line L1. It is to be noted that each of the L-shaped portions 41*a* and 41*b* has a width that allows a high-frequency signal, which is transmitted/received to/from another coupler apparatus, to be supplied in a substantially entire region.

Thus, the rectangular portions 41*c* and 41*d* form a first conductive portion having two ends E23 and E24. Furthermore, the rectangular portions 41*a* and 41*b* form second and third conductive portions having ends E21 and E22, respectively.

The short elements 22 and 23 are joined and connected with the coupling element 41 at ends of the rectangular portions 41*c* and 41*d*.

In this coupling element 41, the ends E21 and E22 of the L-shaped portions 41*a* and 41*b* function as open ends, and the ends E23 and E24 of the rectangular portions 41*c* and 41*d* serve as ground ends, respectively. Therefore, in the coupling element 41, coupling currents are generated in a current path leading to the end E21 from the feeding point P3 through the L-shaped portion 41*a* and a current path leading to the end E22 from the feeding point P3 through the L-shaped portion 41*b*. A size of the coupling element 41 is determined in such a manner a length of each of these two current paths substantially corresponds to n/4 (n is an arbitrary integer) of a wavelength λ of a necessary frequency.

As described above, in the coupling element 41, since the ground currents generated in the rectangular portions 41*c* and 41*d* have different directions, bias of a current distribution in the entire coupler apparatus 4 is smaller than that in an example where the single ground end is provided.

In this embodiment in particular, since the rectangular portions 41*c* and 41*d* are point-symmetric with the feeding point P3 at the center, the two ground currents are also symmetrical, and the current distribution in the entire coupler apparatus 4 is hardly biased due to these ground currents.

Meanwhile, electromagnetic coupling of the two coupler apparatuses 4 is mainly realized by a coupling current produced in each of the L-shaped portions 41*a* and 41*b*, but this coupling current includes current components in three directions which differ every 90 degrees as indicated by arrows in FIG. 11. Therefore, when the two coupler apparatuses 4 face each other in a positional relationship depicted in FIG. 7, current components in opposed directions are present in both the coupler apparatuses 2 in each of states of 0 degree, 90 degrees, 180 degrees, and 270 degrees, thereby reducing a change in degree of coupling in each state.

Figure 12:
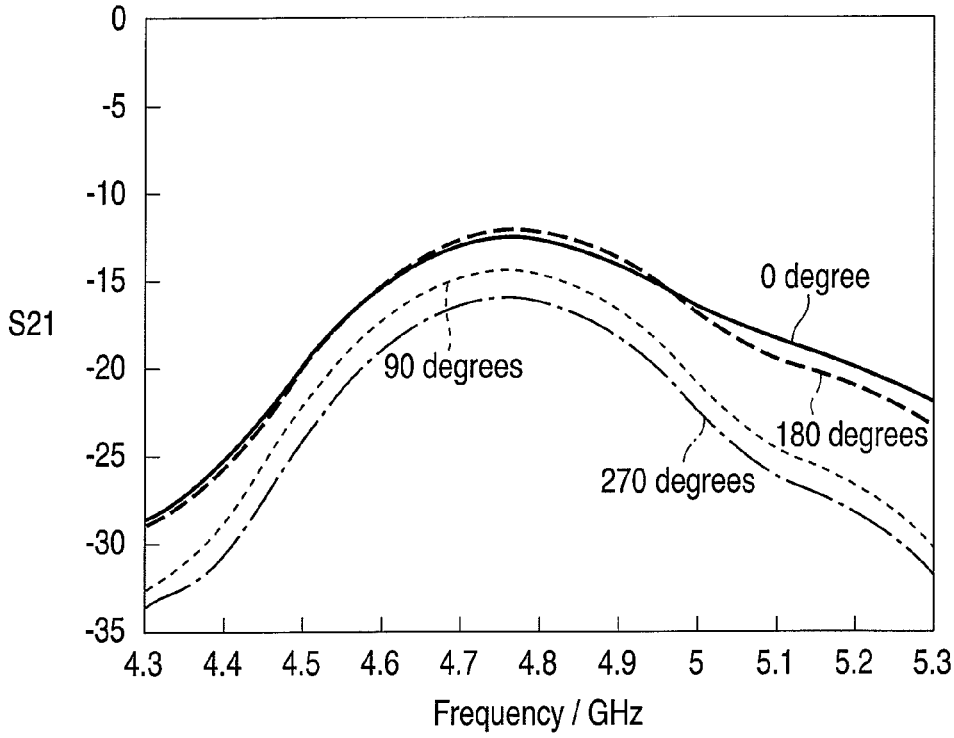
FIG. 12 is a view showing simulation data concerning frequency characteristics of a transmission coefficient (S21) of the coupler apparatuses depicted in FIG. 11.

FIG. 12 is a view showing simulation data concerning frequency characteristics of a transmission coefficient (S21) in the two coupler apparatuses 4. In regard to the characteristics depicted in this FIG. 12, the transmission coefficient (S21) when the two coupler apparatuses 4 face each other in the positional relationship depicted in FIG. 7 is obtained by computer simulation.

However, the current distribution in the entire coupler apparatus 4 is biased due to currents on the end sides of the L-shaped portions 41*a* and 41*b* as compared with the coupler apparatus 2. However, the coupling currents in the L-shaped portions 41*a* and 41*b* are smaller than the ground currents in the rectangular portions 41*c* and 41*d*, and the coupling currents are reduced as getting closer to the ends E21 and E22. Therefore, the bias of the current distribution due to the currents on the end sides of the L-shaped portions 41*a* and 41*b* is smaller than the bias of the current distribution due to the current flowing toward the single ground end.

It is to be noted that a bending angle of each of the L-shaped portions 41*a* and 41*b* may be other than 90 degrees and the L-shaped portions 41*a* and 41*b* may have different bending angles. The L-shaped portions 41*a* and 41*b* may have different shapes. An angle formed by the L-shaped portions 41*a* and 41*b* at the feeding point P3 may be other than 180 degrees. However, the L-shaped portions 41*a* and 41*b* are placed on opposed sides to sandwich a plane that includes the feeding point P3 and is parallel to the front-and-back direction.

On the other hand, the rectangular portions 41*c* and 41*d* may have different shapes. An angle formed by the rectangular portions 41*c* and 41*d* at the feeding point P3 may be other than 180 degrees. However, the L-shaped portions 41*a* and 41*b* are placed on opposed sides to sandwich a plane that includes the feeding point P3 and is parallel to the front-and-back direction.

Fourth Embodiment

Figure 13:
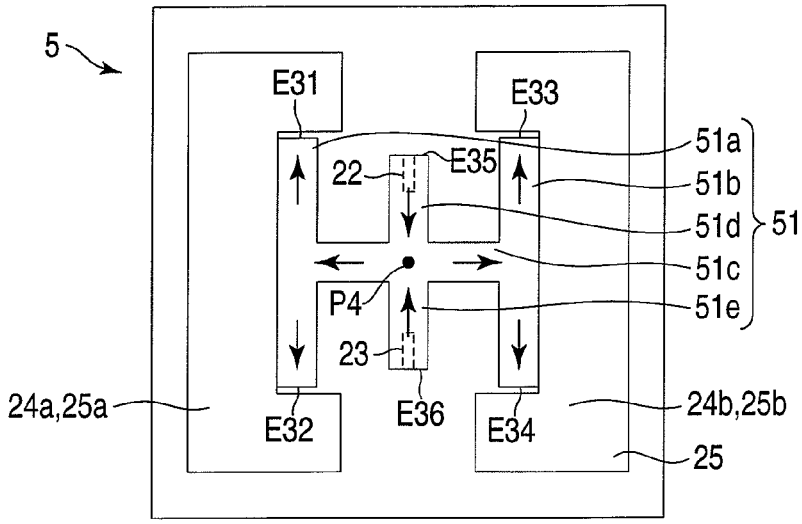
FIG. 13 is a plan view of a coupler apparatus according to a fourth embodiment.

FIG. 13 is a plan view of a coupler apparatus 5 according to a fourth embodiment. It is to be noted that like reference numerals denote parts equal to those in FIG. 1 to FIG. 3, thereby omitting a detailed description thereof.

As shown in FIG. 13, the coupler apparatus 5 includes short elements 22 and 23, a ground plane 24, a dielectric 25, and a coupling element 51. Further, the coupler apparatus 5 also includes such a feeder cable 26 and a connector 27 as depicted in FIG. 3, but the feeder cable 26 and the connector 27 are omitted in FIG. 13.

That is, the coupler apparatus 5 includes a coupling element 51 in place of the coupling element 21 in the coupler apparatus 2. Furthermore, the coupling element 51 and the coupling element 21 have different shapes on a plane orthogonal to each of their thickness directions.

In the coupling element 51, rectangular portions 51*a*, 51*b*, 51*c*, 51*d*, and 51*e* are present. The rectangular portion 51*a* and 51*b* have a rectangular shape and they are parallel to each other in a separated state. The rectangular portion 51*c* has a rectangular shape, and it extends along an alignment direction of the rectangular portions 51*a* and 51*b* to couple central parts of the rectangular portions 51*a* and 51*b* with each other. The rectangular portions 51*d* and 51*e* have a rectangular shape, and they are linearly aligned to sandwich a feeding point P4 therebetween. It is to be noted that each of the rectangular portions 51*a*, 51*b*, and 51*c* has a width that allows a high-frequency signal transmitted/received with respect to another coupler apparatus to be supplied in a substantially entire region.

Thus, the rectangular portions 51*d* and 51*e* form a first conductive portion having two ends E35 and E36. Moreover, the rectangular portion 51*a* and a part of the rectangular portion 51*c* form a conducive portion having ends E31 and E32, and the rectangular portion 51*b* and a part of the rectangular portion 51*c* form a conductive portion having ends E33 and E34. Additionally, the ends E31, E32, E33 and E34 are provided at positions symmetrical with respect to the center of the end E35 and the end E36.

The short elements 22 and 23 are joined and connected to the coupling element 51 at ends of the rectangular portions 51*d* and 51*e*, respectively.

In this coupling element 51, the ends E31, E32, E33, and E34 of the rectangular portions 51*a* and 51*b* serve as open ends, and the ends E35 and E36 of the rectangular portions 51*d* and 51*e* function as ground ends. Therefore, in the coupling element 51, coupling currents are generated in two current paths leading to the ends E31 and E32 from the feeding point P4 through the rectangular portion 51*c* and the rectangular portion 51*a* and two current paths leading to the ends E33 and E34 from the feeding point P4 through the rectangular portion 51*c* and the rectangular portion 51*b*. A size of the coupling element 51 is determined in such a manner that a length of each of these four current paths substantially corresponds to n/4 (n is an arbitrary integer) of a wavelength λ of a necessary frequency.

Thus, in the coupling element 51, since respective ground currents generated in the rectangular portions 51*d* and 51*e* have different directions, bias of a current distribution in the entire coupler apparatus 5 is smaller than that in an example where the single ground end is provided.

In this embodiment in particular, since the rectangular portions 51*d* and 51*e* are point-symmetric with the feeding point P4 at the center, the two ground currents are also symmetric, and the current distribution in the entire coupler apparatus 4 is hardly biased by these ground currents.

Meanwhile, although electromagnetic coupling of the two coupler apparatuses 5 is realized by a coupling current generated in each of the rectangular portions 51*c*, 51*d*, and 51*e*, this coupling current contains current components in four directions that differ every 90 degrees as indicated by arrows in FIG. 13. Therefore, when the two coupler apparatuses 5 are arranged to face each other in a positional relationship depicted in FIG. 7, current components in opposed directions are present in both the coupler apparatuses 2 in each of states of 0 degree, 90 degrees, 180 degrees, and 270 degrees, thereby reducing a change in degree of coupling in each state.

Figure 14:
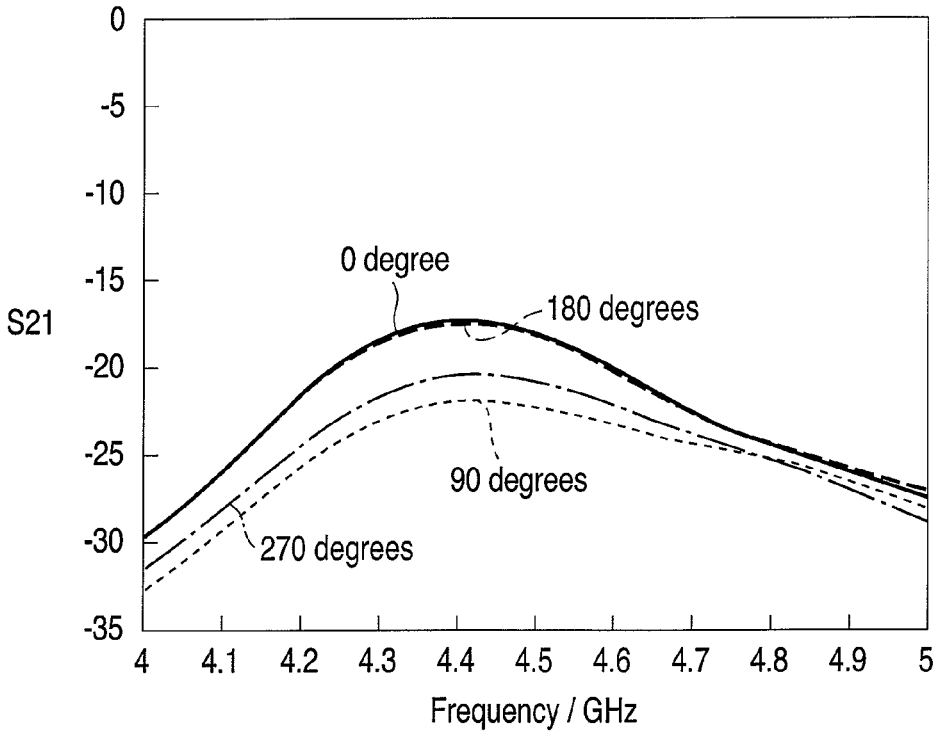
FIG. 14 is a view showing simulation data concerning frequency characteristics of a transmission coefficient (S21) of the coupler apparatuses depicted in FIG. 13.

FIG. 14 is a view showing simulation data concerning frequency characteristic of a transmission coefficient (S21) in the two coupler apparatuses 5. In regard to the characteristics shown in this FIG. 14, the transmission coefficient (S21) when the two coupler apparatuses 5 are arranged to face each other in the positional relationship depicted in FIG. 7 is obtained by computer simulation.

Fifth Embodiment

Figure 15:
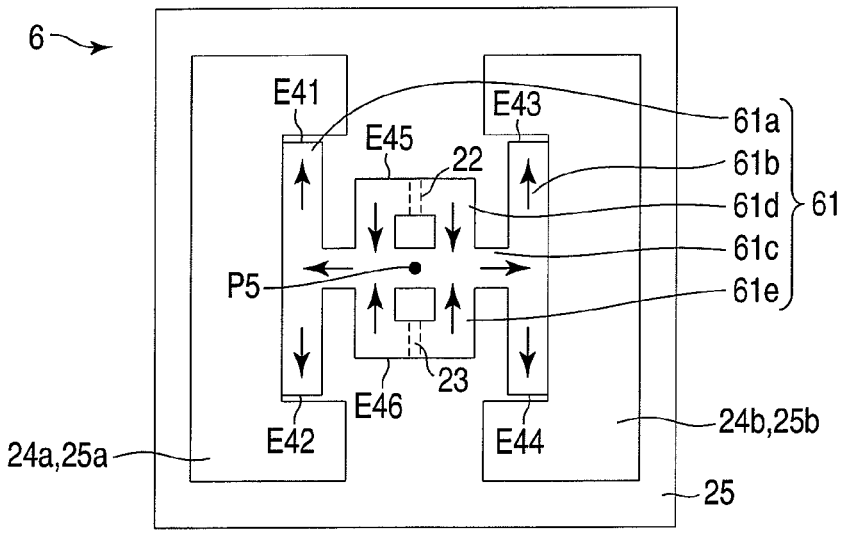
FIG. 15 is a plan view of a coupler apparatus according to a fifth embodiment.

FIG. 15 is a plan view of a coupler apparatus 6 according to a fifth embodiment. It is to be noted that like reference numerals denote parts equal to those in FIG. 1 to FIG. 3 to omit a detailed description thereof.

As shown in FIG. 15, the coupler apparatus 6 includes short elements 22 and 23, a ground plane 24, a dielectric 25, and a coupling element 61. Further, the coupler apparatus 6 also includes such a feeder cable 26 and a connector 27 as depicted in FIG. 3, but the feeder cable 26 and the connector 27 are omitted in FIG. 15.

That is, the coupler apparatus 6 includes a coupling element 61 in place of the coupling element 21 in the coupler apparatus 2. Furthermore, the coupling element 61 and the coupling element 21 have different shapes on a plane orthogonal to each of their thickness directions.

In the coupling element 61, rectangular portions 61*a*, 61*b*, and 61*c* and U-shaped portions 61*d* and 61*e* are present. The rectangular portion 61*a* and 61*b* have a rectangular shape and they are parallel to each other in a separated state. The rectangular portion 61*c* has a rectangular shape, and it extends along an alignment direction of the rectangular portions 61*a* and 61*b* to couple central parts of the rectangular portions 61*a* and 61*b* with each other. The U-shaped portions 61*d* and 61*e* have a U-like shape, and both ends of each of these portions are in contact with the rectangular portion 61*c*. The U-shaped portions 61*d* and 61*e* are point-symmetrical with a feeding point P5 at the center. It is to be noted that each of the rectangular portions 61*a*, 61*b*, and 61*c* has a width that allows a high-frequency signal transmitted/received with respect to another coupler apparatus to be supplied in a substantially entire region.

Thus, the U-shaped portions 61*d* and 61*e* form a first conductive portion having two ends E45 and E46. Moreover, the rectangular portion 61*a* and a part of the rectangular portion 61*c* form a conducive portion having ends E41 and E42, and the rectangular portion 61*b* and a part of the rectangular portion 61*c* form a conductive portion having ends E43 and E44. Additionally, the ends E41, E42, E43 and E44 are provided at positions symmetrical with respect to the center of the end E45 and the end E46.

The short elements 22 and 23 are joined and connected to the coupling element 61 at intermediate parts of the U-shaped portions 61*d* and 61*e*, respectively.

In this coupling element 61, the ends E41, E42, E43, and E44 of the rectangular portions 61*a* and 61*b* serve as open ends, and the ends E45 and E46 of the U-shaped portions 61*d* and 61*e* function as ground ends. Therefore, in the coupling element 61, coupling currents are generated in two current paths leading to the ends E41 and E42 from the feeding point P5 through the rectangular portion 61*c* and the rectangular portion 61*a* and two current paths leading to the ends E43 and E44 from the feeding point P5 through the rectangular portion 61*c* and the rectangular portion 61*b*. A size of the coupling element 61 is determined in such a manner that a length of each of these four current paths substantially corresponds to n/4 (n is an arbitrary integer) of a wavelength λ of a necessary frequency.

Thus, in the coupling element 61, likewise, since respective ground currents generated in the rectangular portions 61*d* and 61*e* have different directions, bias of a current distribution in the entire coupler apparatus 6 is smaller than that in an example where the single ground end is provided.

In this embodiment in particular, since the U-shaped portions 61*d* and 61*e* are point-symmetric with the feeding point P5 at the center, the two ground currents are also symmetric, and the current distribution in the entire coupler apparatus 6 is hardly biased by these ground currents.

Meanwhile, although electromagnetic coupling of the two coupler apparatuses 6 is realized by a coupling current generated in each of the rectangular portions 61*c*, 61*d*, and 61*e*, this coupling current contains current components in four directions that differ every 90 degrees as indicated by arrows in FIG. 15. Therefore, when the two coupler apparatuses 6 are arranged to face each other in a positional relationship depicted in FIG. 7, current components in opposed directions are present in both the coupler apparatuses 2 in each of states of 0 degree, 90 degrees, 180 degrees, and 270 degrees, thereby reducing a change in degree of coupling in each state.

Sixth Embodiment

Figure 16:
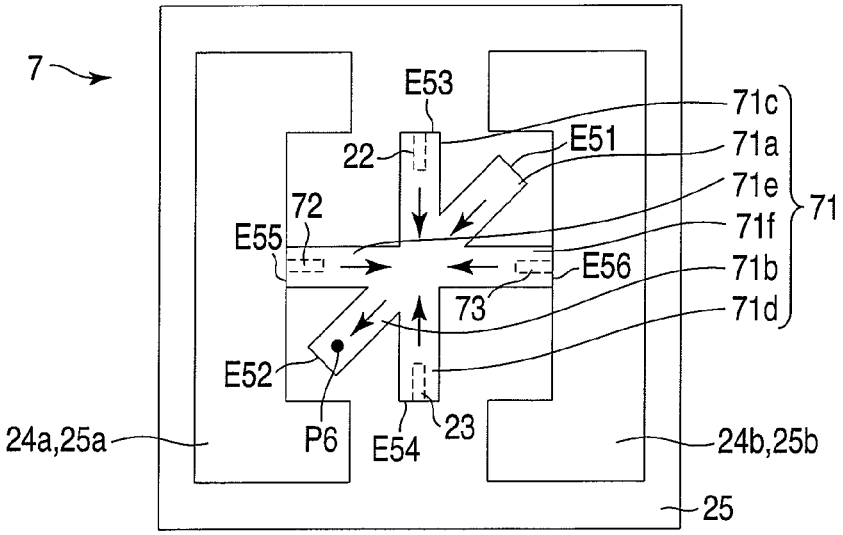
FIG. 16 is a plan view of a coupler apparatus according to a sixth embodiment.

FIG. 16 is a plan view of a coupler apparatus 7 according to a sixth embodiment. It is to be noted that like reference numerals denote parts equal to those in FIG. 1 to FIG. 3 to omit a detailed description thereof.

As shown in FIG. 16, the coupler apparatus 7 includes short elements 22, 23, 72, and 73, a ground plane 24, a dielectric 25, and a coupling element 71. Further, the coupler apparatus 7 also includes such a feeder cable 26 and a connector 27 as depicted in FIG. 3, but the feeder cable 26 and the connector 27 are omitted in FIG. 16.

That is, the coupler apparatus 7 includes a coupling element 71 in place of the coupling element 21 in the coupler apparatus 2 and additionally includes the short elements 72 and 73. Furthermore, the coupling element 71 and the coupling element 21 have different shapes on a plane orthogonal to each of their thickness directions.

In the coupling element 71, rectangular portions 71*a*, 71*b*, 71*c*, 71*d*, 71*e*, and 71*f* are present. The rectangular portions 71*c*, 71*d*, 71*e*, and 71*f* have a positional relationship that these portions form a cross shape. The rectangular portions 71*a* and 71*b* are placed in a state that they extend from an intersecting point of the cross shape in a direction different from those of the other rectangular portions. It is to be noted that each of the rectangular portions 71*a* and 71*b* has a width that allows a high-frequency signal transmitted/received with respect to another coupler apparatus to be supplied in a substantially entire region.

Thus, the rectangular portions 71*c* and 71*d* form a first conductive portion having two ends E53 and E54. Moreover, the rectangular portions 71*a* and 71*b* form a second conductive portion having an end E5. Additionally, the rectangular portions 71*e* and 71*f* form a third conductive portion having two ends E55 and E56.

The short elements 22, 23, 72, and 73 are joined and connected with the coupling element 71 at ends of the rectangular portions 71*c*, 71*d*, 71*e*, and 71*f*. Further, the short elements 72 and 73 are also connected to the ground plane 24 like the short elements 22 and 23. The feeder cable 26 is connected to the coupling element 71 near the end E52 of the rectangular portion 71*b*, and a feeding point P6 is formed near this end E52.

In this coupling element 71, the end E51 of the rectangular portion 71*a* serves as an open end, and the ends E53, E54, E55, and E56 of the rectangular portions 71*c*, 71*d*, 71*e*, and 71*f* function as ground ends, respectively. Therefore, in the coupling element 71, a coupling element is generated in a current path leading from the feeding point P6 to the end E51 through the rectangular portion 71*b* and the rectangular portion 71*a*. A size of the coupling element 71 is determined in such a manner that a length of this current path substantially corresponds to n/4 (n is an arbitrary integer) of a wavelength λ of a necessary frequency.

Four current paths leading to the respective ends E53, E54, E55, and E56 are generated from the intersecting point of the cross shape, and ground currents flow through the rectangular portion 71*c*, 71*d*, 71*e*, and 71*f*. Further, these ground currents have different directions, and hence bias of a current distribution in the entire coupler apparatus 7 is smaller than that in an example where the single ground end is provided.

In this embodiment in particular, since the rectangular portions 71*c*, 71*d*, 71*e*, and 71*f* are point-symmetric with the intersecting point of the cross shape at the center, the four ground currents are also symmetric, and the current distribution in the entire coupler apparatus 4 is hardly biased by these ground currents.

Seventh Embodiment

Figure 17:
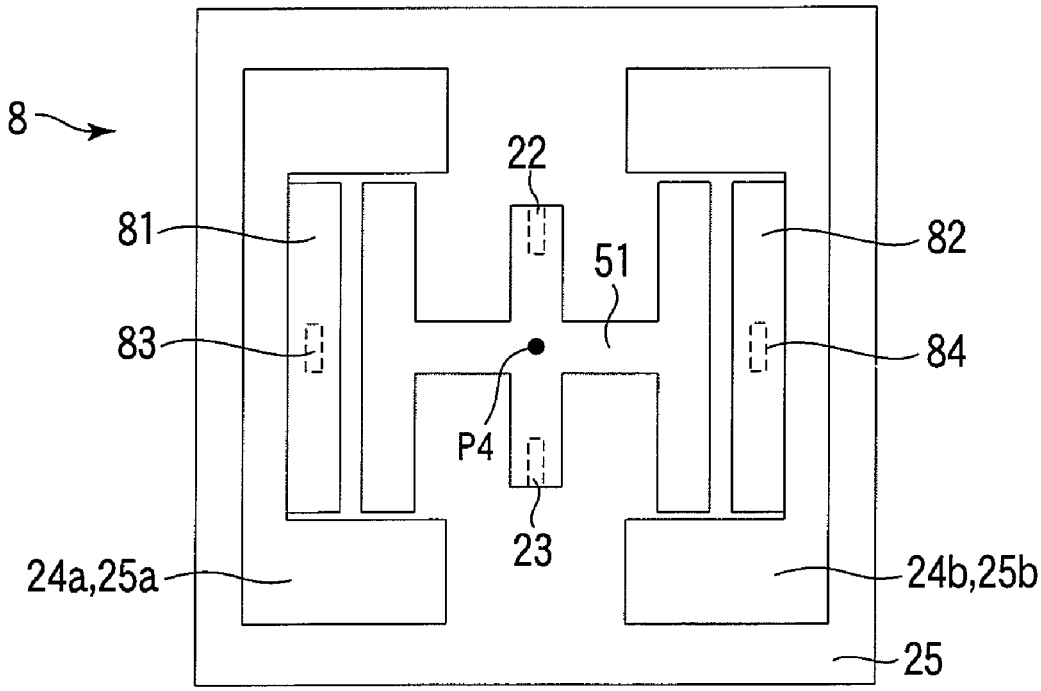
FIG. 17 is a plan view of a coupler apparatus according to a seventh embodiment.

FIG. 17 is a plan view of a coupler apparatus 8 according to a seventh embodiment. It is to be noted that like reference numerals denote parts equal to those in FIG. 1 to FIG. 3 and FIG. 13 to omit a detailed description thereof.

As shown in FIG. 17, the coupler apparatus 8 includes short elements 22 and 23, a ground plane 24, a dielectric 25, a coupling element 51, parasitic elements 81 and 82, and short elements 83 and 84. Moreover, although the coupler apparatus 8 also includes such a feeder cable 26 and a connector 27 as depicted in FIG. 3, the feeder cable 26 and the connector 27 are omitted in FIG. 17.

That is, the coupler apparatus 8 includes the parasitic elements 81 and 82 and the short elements 83 and 84 added to the coupler apparatus 5.

Each of the parasitic elements 81 and 82 is obtained by forming a conductive material into a rectangular tabular shape. The parasitic elements 81 and 82 are adjacent to the coupling element 51 and arranged at positions apart from the coupling element 51. Additionally, the parasitic elements 81 and 82 are arranged in parallel to sandwich the coupling element 51 therebetween.

Each of the short elements 83 and 84 has a rectangular tabular shape and has a thickness direction orthogonal to a thickness direction of each of the parasitic elements 81 and 82. The short element 83 is joined and connected to the parasitic element 81. The short element 83 may be integrated with or separated from the parasitic element 81. The short element 84 is joined and connected to the parasitic element 82. The short element 84 may be integrated with or separated from the parasitic element 82. The short elements 83 and 84 are arranged to penetrate through the dielectric 25 and electrically connected with the ground plane 24.

The parasitic elements 81 and 82 are not connected to a transmission/reception circuit 202, and no power is fed to the parasitic elements 81 and 82.

Figure 18:
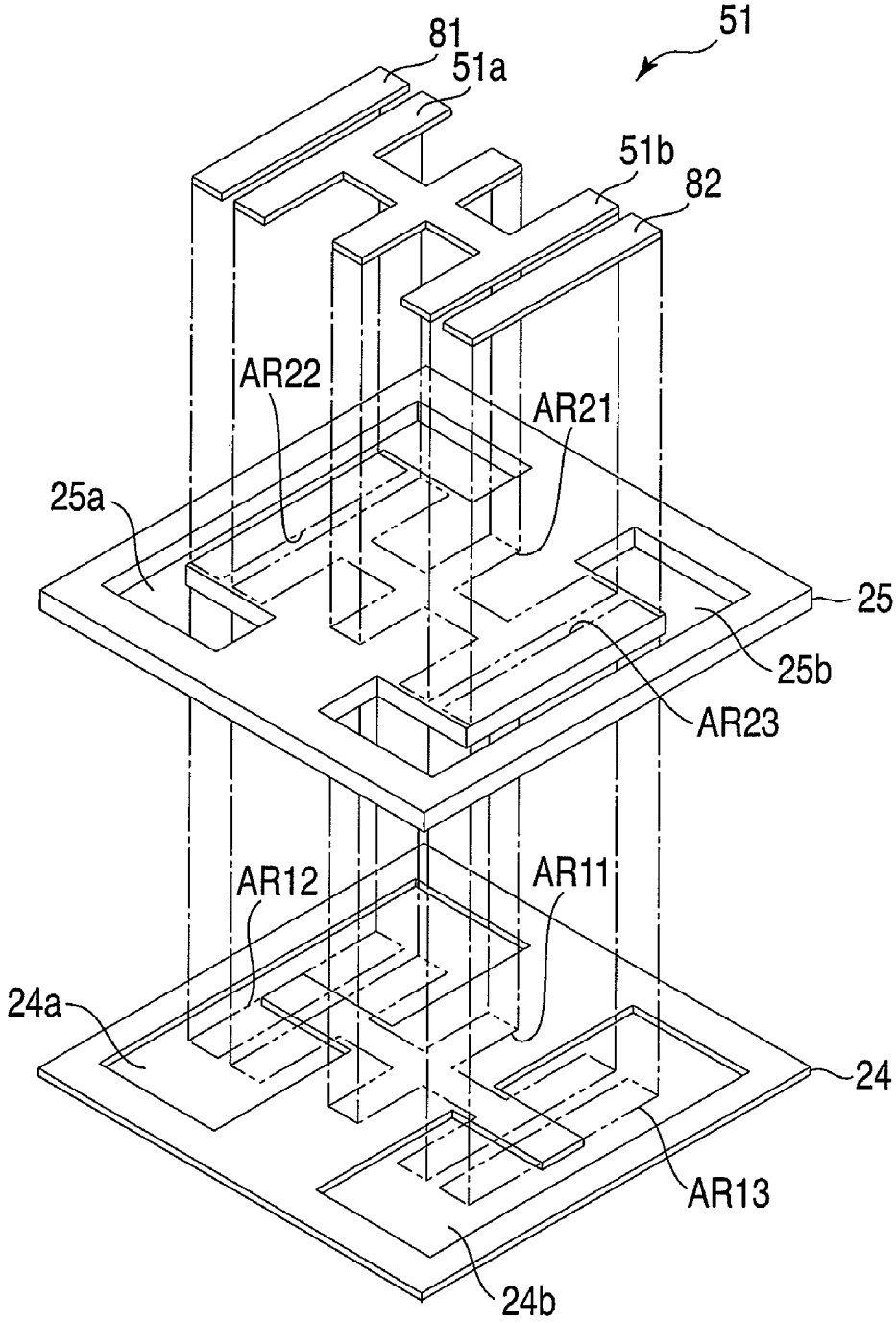
FIG. 18 is an exploded perspective view of the coupler apparatus depicted in FIG. 17.

Projection regions when the coupling element 51 and the parasitic elements 81 and 82 are projected onto a front-side surface of the ground plane 24 in the front-and-back direction (regions facing the coupling element 51 and the parasitic elements 81 and 82) are regions AR11 and AR12, and AR13 indicated by an alternate long and two short dashes line in FIG. 18. It can be understood from FIG. 18 that, since regions in the region AR11 associated with rectangular portions 51*a* and 51*b* partially overlap notches 24*a* and 24*b*, the notches 24*a* and 24*b* are provided to face parts of the rectangular portions 51*a* and 51*b*, namely, the notches 24*a* and 24*b* are provided near regions associated with the rectangular portions 51*a* and 51*b* (adjoining regions). Further, it can be also understood that, since a portion in the region AR11 near a central part thereof does not overlap both the notches 24*a* and 24*b*, the notches 24*a* and 24*b* do not face a feeding point P4. Furthermore, regions in the region AR11 associated with the rectangular portions 51*d* and 51*e* do not overlap both the notches 24*a* and 24*b*, the short elements 22 and 23 can come into contact with the ground plane 24.

Moreover, it can be also understood from FIG. 18 that, since the regions AR12 and AR13 partially overlap the notches 24*a* and 24*b*, the notches 24*a* and 24*b* are provided to face parts of the parasitic elements 81 and 82, namely, the notches 24*a* and 24*b* are provided near regions associated with the parasitic elements 81 and 82 (adjoining regions). It is to be noted that the notches 24*a* and 24*b* in the coupler apparatus 8 have shapes different from those of the notches 24*a* and 24*b* in the coupler apparatus 2 so that the ground plane 24 can have convex portions extending to positions associated with central parts of the parasitic elements 81 and 82. As a result, the short elements 83 and 84 can come into contact with the ground plane 24.

Projection regions when the coupling element 51 and the parasitic elements 81 and 82 are projected onto a front surface side of the dielectric 25 in the front-and-back direction (regions facing the coupling element 51 and the parasitic elements 81 and 82) are regions AR21, AR22, and AR23 indicated by an alternate long and two short dashes line in FIG. 18. It can be understood from FIG. 18 that, since all the regions AR21, AR22, and AR23 do not overlap notches 25*a* and 25*b*, the notches 25*a* and 25*b* are provided in such a manner that they do not face all of the coupling element 51 and the parasitic elements 81 and 82.

Adopting such a configuration enables acquiring a wider communication area than a communication area obtained by the coupler apparatus 5.

This embodiment can be modified in many ways as follows.

At least one of the notches 24*a* and 24*b* does not have to be provided, and notches different from these notches 24*a* and 24*b* may be formed in the ground plane 24. Further, shapes or forming positions of the notches 24*a* and 24*b* can be arbitrarily changed.

At least one of the notches 25*a* and 25*b* does not have to be provided, and notches different from these notches 25*a* and 25*b* may be formed in the dielectric 25. Furthermore, shapes or forming positions of the notches 25*a* and 25*b* can be arbitrarily changed.

The coupling element in each of the foregoing embodiments may be modified to have a convex portion which is joined and connected to a position serving as the feeding point in each of the foregoing embodiments, and the feeder cable 26 may be connected to this convex portion.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A coupler apparatus which transmits or receives an electromagnetic wave to or from another coupler apparatus based on electromagnetic coupling, comprising:

a coupling element which comprises: a first conductor comprising first and second end portions; and a second conductor which extends from a first position between the first end portion and the second end portion and comprising an open end;

a ground plane which faces the coupling element and formed of a conductive material;

a first short element which short-circuits a second position of the coupling element and the ground plane, the second position being closer to the first end portion than the first position is; and a second short element which short-circuits a third position of the coupling element and the ground plane, the third position being closer to the second end portion than the first position is;

wherein the coupling element receives electric power at the first position.

2. The apparatus of claim 1, wherein the coupling element comprises a third conductor which extends from the first position and has an open end, and the open end of the second conductor and the open end of the third conductor are provided at positions symmetrical with respect to the first position.

3. The apparatus of claim 1, wherein the apparatus further comprises third and fourth short elements which short-circuit the ground plane and the coupling element, the coupling element comprises: a third conductor which extends from the first position and has a third end portion; and a fourth conductor which extends from the first position and has a fourth end portion, the third conductor is connected with the third short element at a position closer to the third end portion than the first position is, and the fourth conductor is connected with the fourth short element at a position closer to the fourth end portion than the first position is.

4. The apparatus of claim 1, wherein the second position is the first end portion; and the third position is the second end portion.

5. The apparatus of claim 4, wherein the ground plane has a notch portion at a position facing at least a part of the coupling element except the first position or near the position.

6. The apparatus of claim 1, wherein the first position is a center between the first end portion and the second end portion.

7. The apparatus of claim 6, wherein the coupling element comprises a third conductor which extends from the first position and has an open end, and the open end of the second conductor and the open end of the third conductor are provided at positions symmetrical with respect to the first position.

8. The apparatus of claim 1, further comprising:

a parasitic element which is arranged apart from the coupling element and formed of a conductive material; and an element which short-circuits the parasitic element and the ground plane.

9. The apparatus of claim 1, wherein a dielectric body which faces the coupling element and the ground plane is provided between the coupling element and the ground plane.

10. The apparatus of claim 9, wherein at least one of the ground plane and the dielectric body has a notch portion at a position facing at least a part of the coupling element except the first position or near the position.

* * * * *